US005916419A

United States Patent [19]

Nicholson et al.

[11] Patent Number: 5,916,419

[45] Date of Patent: Jun. 29, 1999

[54] CALENDERING SYSTEM USING HARD AND SOFT NIPS

[75] Inventors: Stephen Nicholson; Steven Herman Parker; Domenick Larry Raschella, all of Covington, Va.; Sharon Rae Stampfl, Columbia, Md.

[73] Assignee: Westvaco Corporation, New York, N.Y.

[21] Appl. No.: 08/980,781

[22] Filed: Dec. 1, 1997

[51] Int. Cl.[6] ..... B05D 3/12; D21G 1/00

[52] U.S. Cl. ..... 162/136; 162/206; 162/360.2; 162/360.3; 162/361; 427/361; 427/366

[58] Field of Search ..... 427/366, 361; 162/361, 360.1, 206, 358, 205, 360.2, 360.3, 161, 136

[56] References Cited

U.S. PATENT DOCUMENTS

| | | | |
|---|---|---|---|
| 1,423,969 | 7/1922 | Schurmann . | |
| 2,395,992 | 4/1946 | Clark | 427/361 |
| 3,124,480 | 3/1964 | Mahoney et al. . | |
| 3,124,481 | 3/1964 | Mahoney . | |
| 3,268,354 | 8/1966 | Hain | 427/194 |
| 3,338,735 | 8/1967 | Hain . | |
| 3,617,445 | 11/1971 | Brafford . | |
| 3,982,056 | 9/1976 | Holder, Jr. | 427/361 |
| 4,492,612 | 1/1985 | Matarainen . | |
| 4,534,829 | 8/1985 | Ahrweiler et al. . | |
| 4,624,744 | 11/1986 | Vreeland | 162/206 |
| 4,670,102 | 6/1987 | Maurer et al. . | |
| 4,915,026 | 4/1990 | Halme . | |
| 5,237,915 | 8/1993 | Rounsley | 100/162 R |

OTHER PUBLICATIONS

H.L. Schmidlin, Raybestos–Manhattan, Inc., "Rubber roll hardness–another look," Pulp & Paper, Mar. 18, 1968.

*Primary Examiner*—Peter Chin
*Assistant Examiner*—Kevin Cronin
*Attorney, Agent, or Firm*—J. R. McDaniel; R. L. Schmalz

[57] ABSTRACT

This invention relates to calendering systems. Such structures of this type, generally, employ the use of hard and soft nips acting on a heated roll to provide excellent smoothness without gloss mottle.

7 Claims, 1 Drawing Sheet

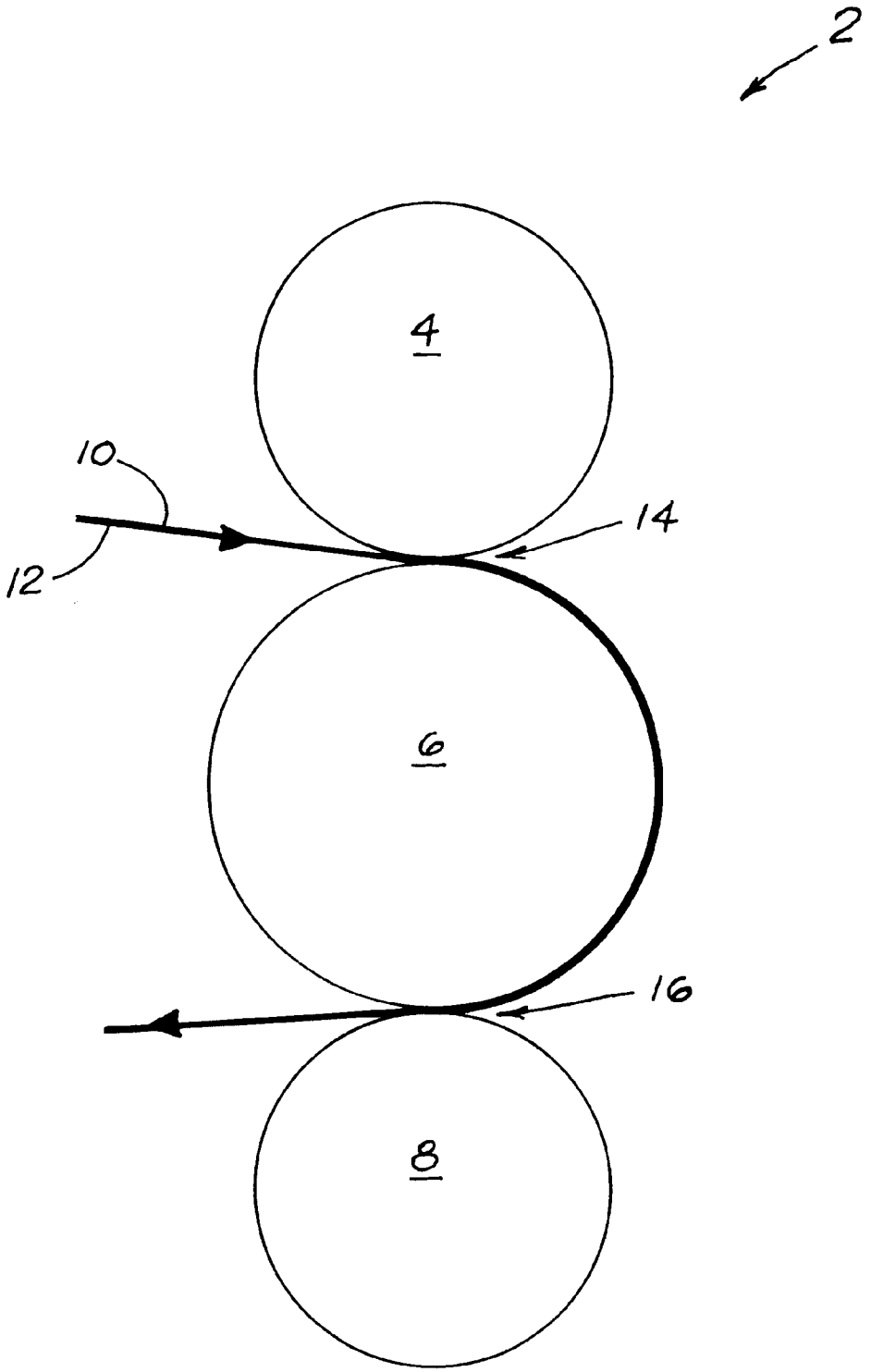
FIGURE

CALENDERING SYSTEM USING HARD AND SOFT NIPS

BACKGROUND OF THE INVENTION

1. Field of the Invention

This invention relates to calendering systems. Such structures of this type, generally, employ the use of hard or soft nips to provide excellent smoothness without gloss mottle.

2. Description of the Related Art

It is well known in calendering systems, particularly heated soft roll calendering systems, to employ a soft roll at high pressures. Exemplary of such prior art is U.S. Pat. No. 4,624,744 ('744) to J. H. Vreeland, entitled "Method of Finishing Paper Utilizing Substrata Thermal Molding". While the '744 patent does achieve calendering, the use of the high nip pressures, namely, pressures above 2000 psi, reduce the bulk of the paper. Consequently, such use of a calendering device is, typically, employed when calendering fine papers. Consequently, a more advantageous calendering system, then, would be employed if calendering could be done at lower nip pressures in order to reduce bulk loss.

It is apparent from the above that there exists a need in the art for a calendering system which is able to calender as well as the known calendering systems, while providing excellent smoothness without gloss mottle (an uneven pattern of gloss or reflectance), but at the same time is able to calender at lower nip pressures.

It is a purpose of this invention to fulfill this and other needs in the art in a manner more apparent to the skilled artisan once given the following disclosure.

SUMMARY OF THE INVENTION

Generally speaking, this invention fulfills these needs by providing a substantially gloss mottle-free calendered paper with significantly increased smoothness consisting of a coated paper produced by a method comprising, passing the coated paper through a first nip formed between a substantially harder calendering roll and a heated roll means, passing the coated paper through a second nip formed between a substantially softer calendering roll and the heated roll means to produce a substantially gloss mottle-free calendered paper having significantly increased smoothness and operating the method at nip pressures between the first and second nip of substantially less than 2000 psi.

In certain preferred embodiments, the harder calendering roll has a surface hardness of greater than 80 shore D. The heated roll is a polished metallic roll. The softer calendering roll has a surface hardness of less than or equal to 80 shore D. Also, calcium carbonate ($CaCO_3$) is added to the coating placed upon the paper. The coating is applied at a coat weight of approximately 8–24 lbs/3000 $ft^2$. The coating contains at least 40% solids and at least 30% $CaCO_3$.

In another further preferred embodiment, the use of the harder-softer roll combination allows one to produce a paper which is substantially gloss mottle-free and has a significantly increased smoothness.

The preferred calendering system, according to this invention, offers the following advantages: good stability; good durability; substantially reduced gloss mottle; significantly increased smoothness; reduced operating nip pressures; increased operating capacity; reduced converting problems; and excellent economy. In fact, in many preferred embodiments, these factors of improved gloss mottle, improved smoothness, reduced nip pressures, increased capacity, and reduced converting problems are optimized to an extent that is considerably higher than heretofore achieved in prior, known calendering systems.

BRIEF DESCRIPTION OF THE DRAWING

The above and other features of the present invention, which will become more apparent as the description proceeds, are best understood by considering the following detailed description in conjunction with the accompanying FIGURE, in which the FIGURE is a schematic illustration of a calendering system using hard and soft rolls, according to the present invention.

DETAILED DESCRIPTION OF THE INVENTION

As discussed earlier, the '744 patent adequately calenders fine papers, but at higher nip pressures. Typically, these nip pressures are greater than 2000 psi as measured by Equation (1) below as set forth by H. L. Schmidt, Rubber Roll Hardness-Another Look, Pulp and Paper, Mar. 18, 1968, pp 30–32. The Equation (1) is:

$$nip\ \text{width}, n = \left(\frac{4LTD_1D_2}{E(D_1 + D_2)}\right)^{1/m} \quad (1)$$

m=exponent which is dependent on roll diameter

L=line load (pli)

T=thickness of cover (inches)

$D_1$=diameter of harder roll (inches)

$D_2$=diameter of softer roll (inches)

E=elastic modulus

However, in today's modern paper manufacturing machines, it is desirable to run at lower nip pressures, i.e., substantially less than 2000 psi. These lower nip pressures reduce bulk loss of the calendered paper and allow paper with greater caliper or thickness to be produced. Using Equation (1), nip pressures in the present invention have been measured from 900 to 1400 psi.

Along with reducing bulk loss, there are several other desired qualities that a paper manufacturer wants the paper to achieve after calendering. From past studies, it has been determined that a Parker Print-Surf (a measurement of surface roughness) of 1.0 or less and a gloss (or reflectance) of greater than or equal to 60 based upon a 75° Hunter gloss are currently acceptable parameters for determining whether or not a paper is calendered to achieve the best results.

With reference first to the FIGURE, there is illustrated an advantageous environment for use of the concepts of the invention. In particular, as shown in the FIGURE, there is illustrated calendering system 2. System 2, includes in part, harder or backing roll 4 having a hard resiliently yieldable surface, conventionally treated, polished metal roll 6, softer or backing roll 8 having a soft resiliently yieldable surface, conventional paper 10, coating 12, and nips 14 and 16. It is to be understood that softer roll 8 may also be located ahead of harder roll 4. Also, roll 6 may be a series of heated rolls such that substrate 10 does not wrap around roll 6 and nips 14 and 16 located in a series.

Harder roll 4, preferably, is any roll constructed of natural or synthetic materials having a surface hardness of greater than 80 shore D measured by conventional techniques. Softer roll 8, preferably, is any suitable roll constructed of natural or synthetic materials having a surface hardness of less than or equal to 80 shore D.

Paper substrate 10 of the present invention is coated by coating 12 on at least one side surface and frequently on both sides. The paper trade characterizes a paper web or sheet that has been coated on one side as C1S and C2S if sheet coated on both sides.

Compositionally, coating 12 is a fluidized blend of coating clay, calcium carbonate ($CaCO_3$), and/or titanium dioxide with binders and additives which is smoothly applied to the traveling web surface. In particular, $CaCO_3$ is added to the fluidized blend of minerals such that the $CaCO_3$ comprises greater than 30% by weight of the minerals. Also, the mixture includes at least 40% by weight of solids in order to reduce gloss mottle and increase smoothness.

Coating 12 is applied to paper 10 at a rate of 8–24 lbs/3000 $ft^2$ by conventional techniques. Preferably, coating 12 is applied by a means of a rod coater, air knife or blade by conventional techniques.

The following test results prove the novelty of the present invention and its application as a desired calendering system.

Using coated basestock with a starting Parker Print-Surf value of 1.9 and a caliper value of 0.012", the following results were achieved as shown below in TABLE 1:

TABLE 1

| Load (pli) | Roll Hardness | Caliper (in) | PPS | Sheffield | Gloss |
|---|---|---|---|---|---|
| 348 | Softer | 11.9 | 1.4 | 15 | 61 |
| 417/417 | Harder/Softer | 11.9 | 1.2 | 6 | 68 |
| 348 | Harder | 12.0 | 1.1 | 8 | 68 |

,where PPS = Parker Print-Surf, Softer = Softer roll 8, and Harder = Harder roll 4

The above data demonstrate a more profound effect of the harder polymer roll (88 Shore D) on the larger scale roughness (Sheffield) than on the fine scale roughness (measured by PPS). There was an obvious visual improvement in surface uniformity of the harder/softer roll combination condition as compared to the harder roll only condition.

Using coated basestock with a starting PPS value of 2.4 and a caliper value of 0.11", the following results were achieved as shown below in TABLE 2:

TABLE 2

| Load (pli) | Roll Hardness | Caliper (in) | PPS | Sheffield | Gloss |
|---|---|---|---|---|---|
| 348 | Harder | 10.9 | 1.9 | 10 | 64 |
| 417/417 | Harder/Harder | 10.7 | 1.7 | 10 | 71 |
| 417/417 | Harder/Softer | 10.8 | 1.7 | 13 | 71 |

Again, the harder/softer roll combination provides reduced PPS values and higher gloss values than a single hard roll. Also, the harder/softer roll combination gives better gloss uniformity than the harder/harder roll combination.

Based upon the favorable results from TABLE 1 and TABLE 2, calendering system 2 was placed on a conventional papermaking machine. The paper was calendered using a harder roll (Shore D hardness of greater than 80), two softer rolls (Shore D hardness of less than or equal to 80) and the harder/softer roll combination of the present invention. The results of the three runs are shown below in TABLE 3:

TABLE 3

| Roll Hardness | PPS | Sheffield | Gloss | Mottle |
|---|---|---|---|---|
| Harder | 1.2 | N/A | 62 | Unacceptable Gloss Uniformity |
| Softer/Softer | 1.3 | 6 | 56 | Acceptable Gloss Uniformity |
| Harder/Softer | 0.8 | 4 | 68 | Acceptable Gloss Uniformity |

Clearly, the use of the harder/softer calendering roll combination creates a paper having a Parker Print-Surf of 1.0 or less, a gloss of greater than or equal to 60, and reduced gloss mottle.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method of producing a gloss mottle-free calendered paper having increased smoothness, wherein said method is comprised of the steps of:

coating a paper web or sheet;

passing said coated paper through a first nip located between a single harder calendering roll and a heated roll means;

passing said coated paper through a second nip located between a single softer calendering roll and said heated roll means to produce a gloss mottle-free calendered paper having increased smoothness; and operating said method at nip pressures between said first and second nips of substantially less than 2000 psi wherein said harder roll has a hardness of greater than 80 Shore D and said softer roll has a hardness of less than or equal to 80 Shore D.

2. The method, as in claim 1, wherein said gloss mottle-free calendered paper has a Parker Print-Surf rating less than or equal to 1.0.

3. The method, as in claim 1, wherein the gloss mottle-free calendered paper has a gloss rating of at least 60.

4. The method as in claim 1, wherein said is paper coating is further comprised of:

particulate minerals.

5. The method, as in claim 4, wherein said particulate minerals are further comprised of:

at least 40% by weight solids.

6. The method, as in claim 5, wherein said particulate minerals are further comprised of:

at least 30% by weight of calcium carbonate.

7. The method, as in claim 1, wherein said paper coating has a coat weight of approximately 8–24 lbs/3000 $ft^2$ ream.

* * * * *